US011333451B2

(12) United States Patent
Livni et al.

(10) Patent No.: US 11,333,451 B2
(45) Date of Patent: May 17, 2022

(54) PLATE AND SHELL HEAT EXCHANGING SYSTEM HAVING A DIVIDED MANIFOLD TUBE

(71) Applicants: Zvi Livni, Tel Aviv (IL); Omer Livni, Hod Hasharon (IL)

(72) Inventors: Zvi Livni, Tel Aviv (IL); Omer Livni, Hod Hasharon (IL)

( * ) Notice: Subject to any disclaimer, the term of this patent is extended or adjusted under 35 U.S.C. 154(b) by 32 days.

(21) Appl. No.: 16/621,257

(22) PCT Filed: Jun. 11, 2018

(86) PCT No.: PCT/IL2018/050637
§ 371 (c)(1),
(2) Date: Dec. 11, 2019

(87) PCT Pub. No.: WO2018/229756
PCT Pub. Date: Dec. 20, 2018

(65) Prior Publication Data

US 2020/0116442 A1 Apr. 16, 2020

Related U.S. Application Data

(60) Provisional application No. 62/517,926, filed on Jun. 11, 2017.

(51) Int. Cl.

| | |
|---|---|
| ***F28F 9/22*** | (2006.01) |
| ***F28D 9/00*** | (2006.01) |
| *F28F 9/26* | (2006.01) |

(52) U.S. Cl.
CPC ..... *F28F 9/22* (2013.01); *F28D 9/0093* (2013.01); *F28D 9/0006* (2013.01); *F28F 9/26* (2013.01);
(Continued)

(58) Field of Classification Search
CPC ..... F28F 9/22; F28F 9/26; F28F 2009/224; F28F 2009/226; F28F 9/0131;
(Continued)

(56) References Cited

U.S. PATENT DOCUMENTS

| | | | | |
|---|---|---|---|---|
| 3,271,934 A * | 9/1966 | Shields | F28F 9/26 96/390 |
| 3,675,710 A * | 7/1972 | Ristow | F28B 9/08 165/111 |
| 4,382,467 A * | 5/1983 | Garrison | F28D 7/1638 122/510 |

(Continued)

*Primary Examiner* — Tho V Duong
*Assistant Examiner* — Raheena R Malik
(74) *Attorney, Agent, or Firm* — Mark M. Friedman

(57) ABSTRACT

A heat exchanging system includes a tank including a fluid inlet and a fluid outlet, which encloses (envelopes) a heat exchanger including a manifold tube and one or more one heat exchanging plates, extending from the manifold tube. The manifold tube includes a fluid intake and the fluid outlet, as well as a manifold barrier, which divides the interior of the manifold tube (for example, which is hollow), so as to define within the manifold tube an intake region and an outlet region. The heat exchanging system also has at least one heat exchanging plate extending from the manifold tube, the at least one heat exchanging plate with at least one plate barrier, such that the heat exchanging plate is configured to define a fluid flow path within the heat exchanging plate such that fluid flows from the intake region of the manifold tube.

14 Claims, 5 Drawing Sheets

(52) U.S. Cl.
CPC ..... *F28F 2009/224* (2013.01); *F28F 2009/226* (2013.01)

(58) Field of Classification Search
CPC .... F28D 9/0093; F28D 9/0006; F28D 9/0075; F28D 9/0037; F28D 9/0043
USPC ..... 165/159
See application file for complete search history.

(56) References Cited

U.S. PATENT DOCUMENTS 4,561,498 A * 12/1985 Nowobilski ..... F28F 9/22 165/160
5,148,858 A * 9/1992 Ovretveit ..... F28D 21/0012 165/282
5,186,245 A * 2/1993 Peters ..... F28F 9/0234 165/140
5,279,357 A * 1/1994 Kennon ..... F28G 3/166 122/391
5,333,681 A * 8/1994 Jullien ..... F28D 9/0006 165/145
6,978,793 B1 * 12/2005 Krueger ..... F28F 3/083 134/109
7,264,039 B2 * 9/2007 Dawson ..... F28D 9/0031 165/84
9,863,727 B1 * 1/2018 Van Fleet ..... B08B 13/00
2006/0207757 A1 * 9/2006 Danielsson ..... F28D 7/1638 165/159
2010/0206535 A1 * 8/2010 Munoz ..... F28F 9/0273 165/173
2014/0166241 A1 * 6/2014 Carter ..... F28C 1/14 165/104.14
2016/0223266 A1 * 8/2016 Kux ..... F28D 9/0037
2016/0334175 A1 * 11/2016 Eckert ..... F28D 7/06
2018/0142968 A1 * 5/2018 Deguchi ..... F28F 13/12
2018/0363990 A1 * 12/2018 Ron ..... F28F 3/086

* cited by examiner

PLATE AND SHELL HEAT EXCHANGING SYSTEM HAVING A DIVIDED MANIFOLD TUBE

CROSS-REFERENCES TO RELATED APPLICATIONS

This application is related to and claims priority from commonly owned, U.S. Provisional Patent Application Ser. No. 62/517,926, entitled: Self-Cleaning Plate and Shell Heat Exchanging System, filed on Jun. 11, 2017, the disclosure of which is incorporated by reference in its entirety herein.

TECHNICAL FIELD

The present invention relates to self-cleaning heat exchangers.

BACKGROUND OF THE INVENTION

Heat exchangers are used in numerous industrial sectors such as petroleum, petrochemicals, power, cooling and air conditioning in buildings, like hospitals and commercial buildings. Heat exchanging systems are implemented in cooling towers, air conditioners and the like, to regulate, by either raising or lowering the temperature of one fluid by the exchange of heat with a second fluid, where both fluids are separated by a physical barrier in the heat exchanger. The fluid media can be either liquid or gaseous and may include steam, water, types of inert gases and oil.

The most common types of heat exchangers are known as plate heat exchangers, or shell and tube heat exchangers. Plate heat exchangers use metal plates fitted with gaskets to transfer heat between two fluids directed by the plates into alternate channels. Shell and tube heat exchangers consist of a shell, usually a large pressure vessel or tank, with a number of tubes passing through the interior. A first fluid passes through the tubes while a second fluid moves through the shell, passing around the tubes such that heat is transferred between the two fluids.

SUMMARY OF THE INVENTION

The present invention is directed to a heat exchanging system which includes a divided manifold tube. The present invention provides the advantages of plate style heat exchangers and tube and shell style heat exchangers.

The present invention is directed to a heat exchanging system, which includes a tank including a fluid inlet and a fluid outlet, which encloses (envelopes) a heat exchanger including a manifold tube and one or more one heat exchanging plates, extending from the manifold tube. The manifold tube includes a fluid intake and the fluid outlet, as well as a manifold barrier, which divides the interior of the manifold tube (for example, which is hollow), so as to define within the manifold tube an intake region and an outlet region. The heat exchanging system also has at least one heat exchanging plate extending from the manifold tube, the at least one heat exchanging plate with at least one plate barrier, such that the heat exchanging plate is configured to define a fluid flow path within the heat exchanging plate such that fluid flows from the intake region of the manifold tube, through the heat exchanging plate into the outlet region of the manifold tube.

The present invention is directed to a heat exchanging system comprising a heat exchanger. The heat exchanger includes: a manifold tube including an interior for receiving fluid, the manifold tube including a fluid intake and a fluid outlet, and a manifold barrier extending through the interior for dividing the manifold tube into an intake region and an outlet region; and, at least one heat exchanging plate extending from the manifold tube and in communication with the intake region of the manifold tube and the outlet region of the manifold tube, the at least one heat exchanging plate including at least one plate barrier so as to define a fluid flow path within the heat exchanging plate, from the intake region of the manifold tube to the outlet region of the manifold tube.

Optionally, the manifold barrier divides the interior of the manifold tube substantially longitudinally along a longitudinal axis extending through the center of the manifold tube.

Optionally, the at least one heat exchanging plate includes a plurality of heat exchanging plates extending from the manifold tube, each of the heat exchanging plates including at least one plate barrier defining a fluid flow path within the heat exchanging plate, from the intake region of the manifold tube to the outlet region of the manifold tube.

Optionally, the manifold tube is configured with a plurality of paired inlets and outlets for each plate of the plurality of plates. Optionally, the heat exchanging system additionally comprises: cleaning elements deployed adjacent to the heat exchanging plates.

Optionally, the manifold tube is configured to rotate about a longitudinal axis of the manifold tube.

Optionally, the heat exchanging system additionally comprises a tank including at least one fluid inlet and at least one fluid outlet, the tank enveloping at least a portion of the heat exchanger.

Optionally, the tank is configured for facilitating the flow of a first fluid therethrough, and the heat exchanger is configured for facilitating the flow of a second fluid therethrough.

Optionally, the manifold tube is mounted inside a cooling tower.

The present invention is also directed a heat exchanger. The heat exchanger comprises: a manifold tube including an interior (e.g., the interior being a hollow chamber or cavity) for receiving fluid, the manifold tube including an opening for fluid intake and an opening for fluid egress, and a manifold barrier extending through the interior for dividing the manifold tube into an intake region and an outlet region, the intake region including at least one aperture for fluid flow therethrough, and the outlet region including at least one aperture for fluid flow therethrough; and, at least one heat exchanging plate extending from the manifold tube and in communication with the at least one aperture of the intake region of the manifold tube and the at least one aperture of the outlet region of the manifold tube, the at least one heat exchanging plate including at least one plate barrier configured for forming a fluid flow path within the heat exchanging plate, from the intake region of the manifold tube to the outlet region of the manifold tube.

Optionally, the heat exchanger is such that the manifold barrier divides the interior of the manifold tube longitudinally along a longitudinal axis extending through the center of the manifold tube.

Optionally, the interior is hollow.

Optionally, the manifold tube is configured to rotate about a longitudinal axis of the manifold tube.

Unless otherwise defined herein, all technical and/or scientific terms used herein have the same meaning as commonly understood by one of ordinary skill in the art to which the invention pertains. Although methods and materials similar or equivalent to those described herein may be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the present invention are herein described, by way of example only, with reference to the accompanying drawings. With specific reference to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

Attention is now directed to the drawings, where like reference numerals or characters indicate corresponding or like components. In the drawings.

DETAILED DESCRIPTION OF THE DRAWINGS

Figure 1:
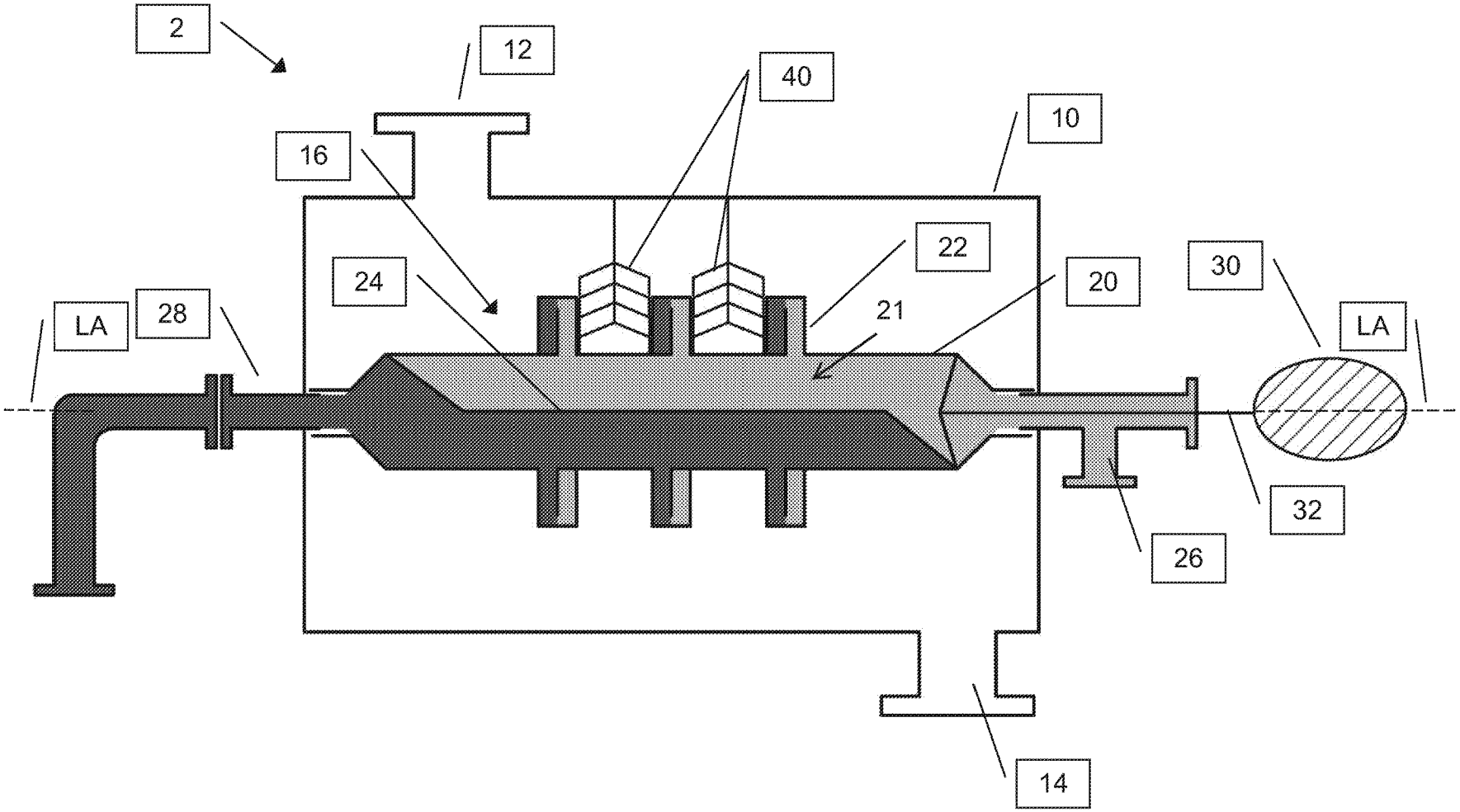
FIG. 1 is cross-sectional view of a heat exchanger in accordance with the present invention.

FIG. 1 illustrates a heat exchanging system 2 formed of a tank/shell 10, which is filed with a first fluid, e.g., liquid and/or gas. The tank/shell 10 includes a fluid inlet 12 and a fluid outlet 14.

A heat exchanger 16, within the tank/shell 10 includes a manifold tube 20, with heat exchange plates 22, for receiving and outputting a second fluid, e.g., liquid and/or gas. The heat exchanger 16 is mounted inside the tank/shell 10. The aforementioned first and second fluids may be the same or different fluids.

The manifold tube 20 includes an interior or interior chamber or cavity 21, through which fluid flows, and which is, for example, a hollow chamber or cavity. Heat exchanging plates 22 extend from the manifold tube 20, inside tank/shell 10. The manifold tube 20 includes a fluid intake (ingress or inflow opening) 26 and a fluid outlet (egress or outflow opening) 28. A manifold barrier 24 divides the interior 21 of the manifold tube 20 into a fluid intake region 20*a* and a fluid outlet region 20*b*. The positioning of the manifold barrier 24 provides for fluid to flow into the heat exchanging plates 22 as the fluid passes from the intake 26 to the fluid outlet 28, such that fluid from the fluid intake region 20*a*, flows into the plate(s) 22, and then to the fluid outlet region 20*b*, from where fluid leaves the manifold tube 20.

The manifold barrier 24 divides the interior 21 (e.g., hollow interior) of manifold tube 20 substantially longitudinally along the length of the manifold tube 20 (e.g., along a longitudinal axis LA extending through the center of the interior 21 of the manifold tube 20, as well as the manifold tube 20 itself). The division is such that the intake region 20*a* and the outlet region 20*b* are separate from each other, whereby fluid does not pass through the manifold barrier 24.

Figure 2A:
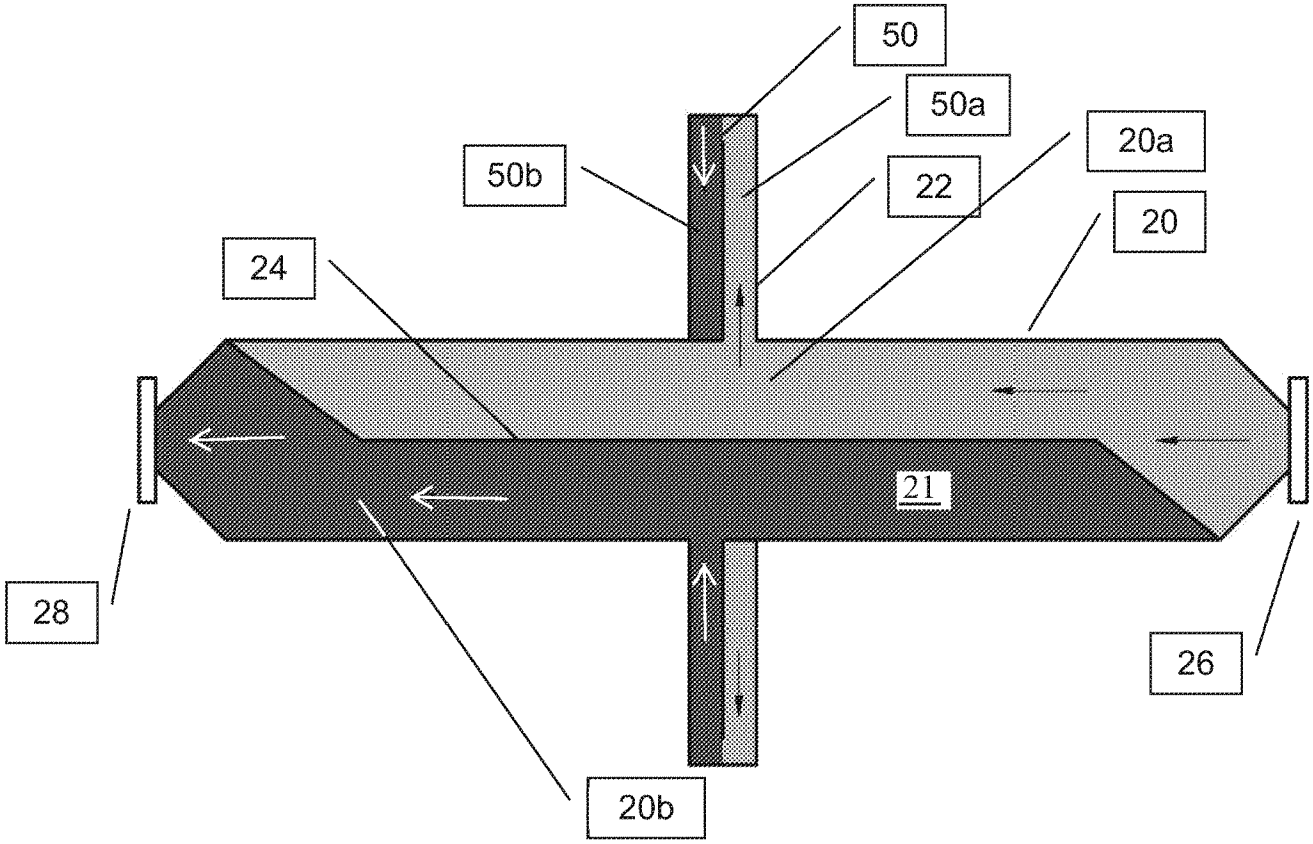
FIG. 2A is cross-sectional view of the manifold tube of the heat exchanger of FIG. 1.

Turning also to FIG. 2A, the heat exchanging plates 22 include a plate barrier 50 that extends radially at least partially into the interior region of each heat exchanging plate 22, and forms channels 50*a*, 50*b* for fluid flow through the plate 22. First channels 50*a* extend from the intake region 20*a*, which feed into second channels 50*b*, through which fluid flows into the outlet region 20*b*. In FIG. 2A, the direction of fluid flow in the interior 21 of the manifold tube 20 is shown by the arrows.

Figure 2B:
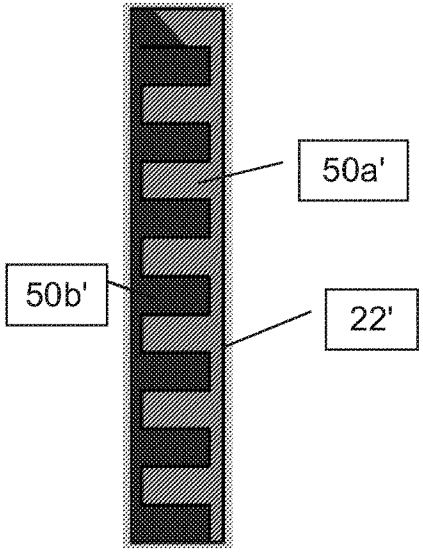
FIG. 2B is cross-sectional view of an alternative plate for the heat exchanging plate of FIG. 2A.

FIG. 2B shows an alternative channel arrangement for the plate 22', as a plate barrier 50' (portion thereof, representative of the entire plate barrier 50') includes corrugations. These corrugations increase the surface area of the channels 50*a*', 50*b*' for heat transfer.

Figure 3:
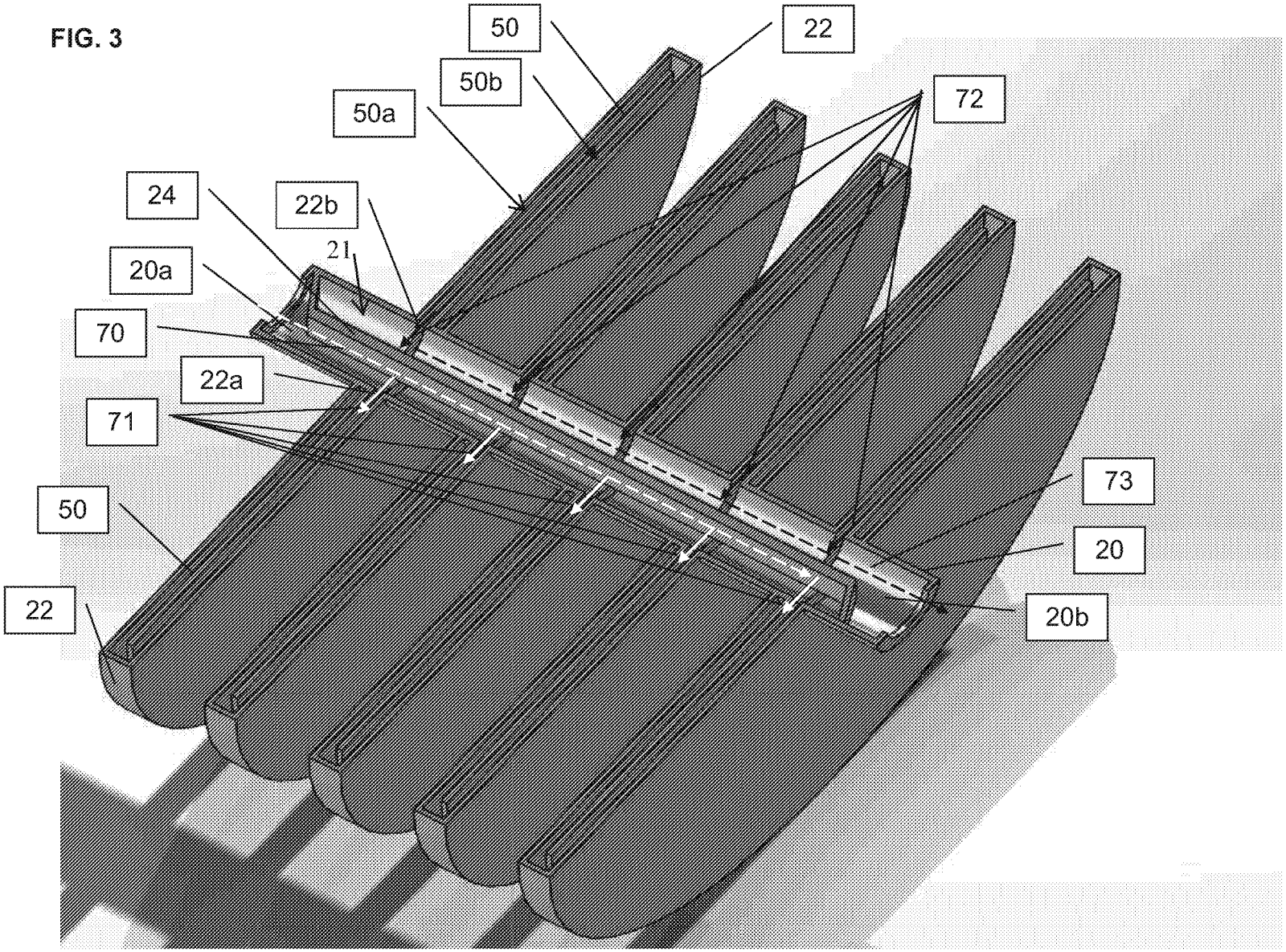
FIG. 3 is an isometric top view cross section of the manifold tube and the heat exchanging plates of the heat exchanger of FIG. 1.
Figure 4:
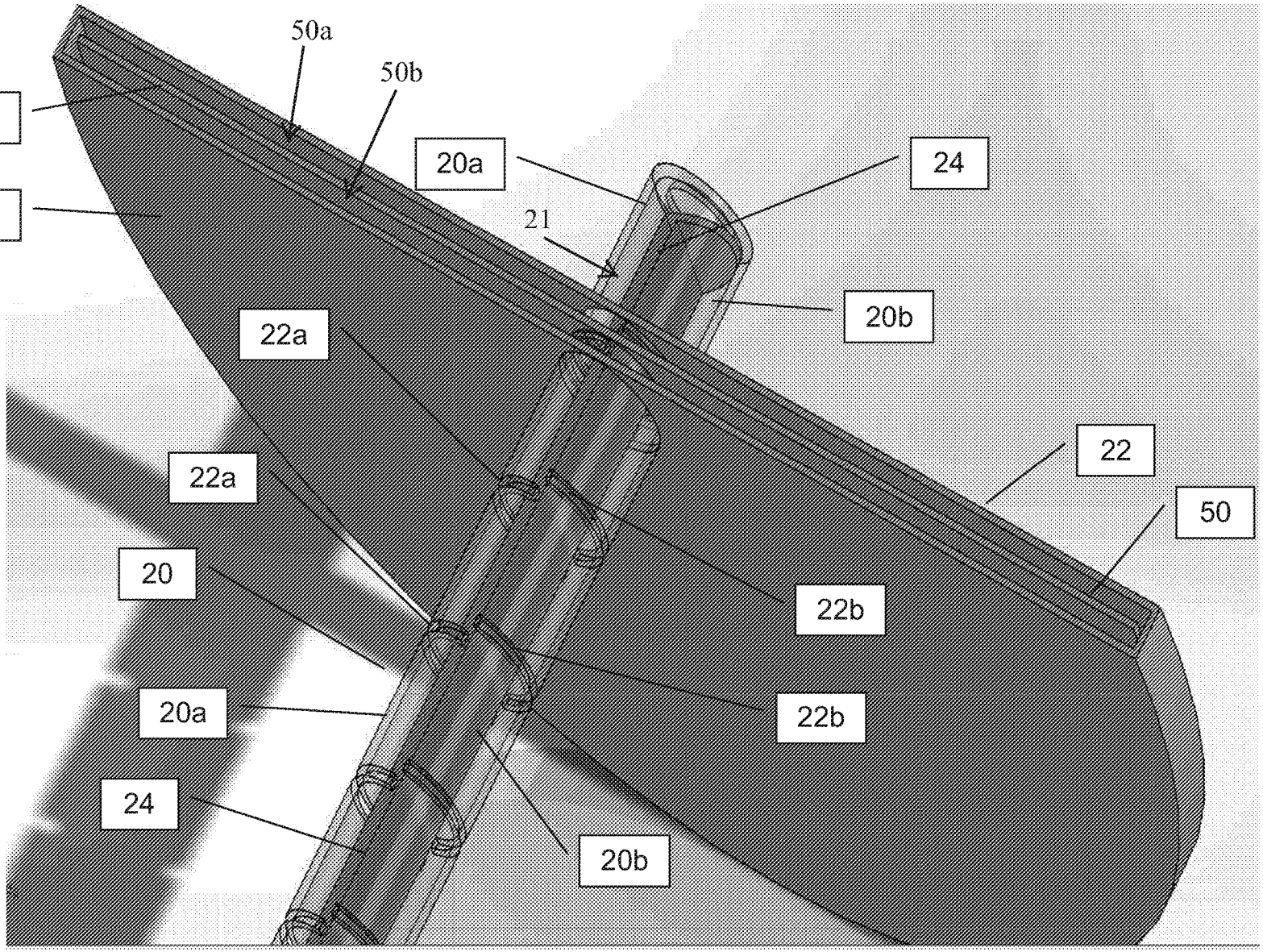
FIG. 4 is an isometric top cut-away view of the manifold tube of FIG. 1; and, FIG. 5 is cross-sectional view of a heat exchanging system as installed in a cooling tower.

FIG. 3 is a cross-sectional view showing multiple plates 22 arranged along the manifold tube 20. The manifold tube 20 includes separate inlets 22*a* and outlets 22*b* for each plate 22, which serve as openings (apertures) for fluid flow for the respective channels 50*a*, 50*b* (of each plate 22). The inlets 22*a* and outlets 22*b* extend as apertures along the perimeter of the manifold tube 20, as shown in FIG. 4, allowing fluid to flow between the channels 50*a*, 50*b* of the plate 22, from the intake region 20*a* to the outlet region 20*b* of the manifold tube 20. For example, fluid flows from the intake region 20*a*, via arrow 70, into the inlets 22*a*, as indicated by arrows 71, through the channels 50*a*, 50*b* of the respective plate 22, and then through the respective outlets 22*b*, into the outlet region 20*b* of the manifold tube 20, via arrows 72, and through the outlet region 20*b* of the manifold tube 20, via arrow 73 to exit the manifold tube 20. While one plate barrier 50 is shown 22, each plate 22 may include multiple plate barriers, provided they terminate in a respective inlet 22*a* and outlet 22*b*, as shown for the barrier 50 of the plate 22 described above.

Optionally, as shown in FIG. 1, the manifold tube 20 is rotatably mounted within tank/shell 10 so as to be rotated about the longitudinal axis LA by a motor 30. Here, a motor drive shaft 32 (which extends along the longitudinal axis LA) passes through the stationary piping and attaches to the manifold tube 20 in the interior of the manifold tube 20.

Cleaning elements 40 are mounted stationary to the tank 10, between the plates 22. This arrangement allows for the outer surfaces of the heat exchanging plates 22 to be kept clean and free of scale and other build-up, so as to maintain the efficiency of the heat exchanging process. Additionally, stationary cleaning elements 40 are, for example, also deployed adjacent to the heat exchanging plates 22. The positioning of the stationary cleaning elements 40 automatically clean the plates 22, for example, by frictional engagements, when the plates 22 are rotated, for example, by the motor 30, as shown in FIG. 1. As seen from FIGS. 1 and 5, cleaning elements 40, 140 may comprise blades.

FIG. 4 illustrates the elements of FIG. 3 from another angle with a single heat exchanging plate 22, but showing several heat exchanging plate 22 inlets 22*a* and outlets 22*b*. An inlet 22*a* is paired with an outlet 22*b* for each of the plates 22.

Figure 5:
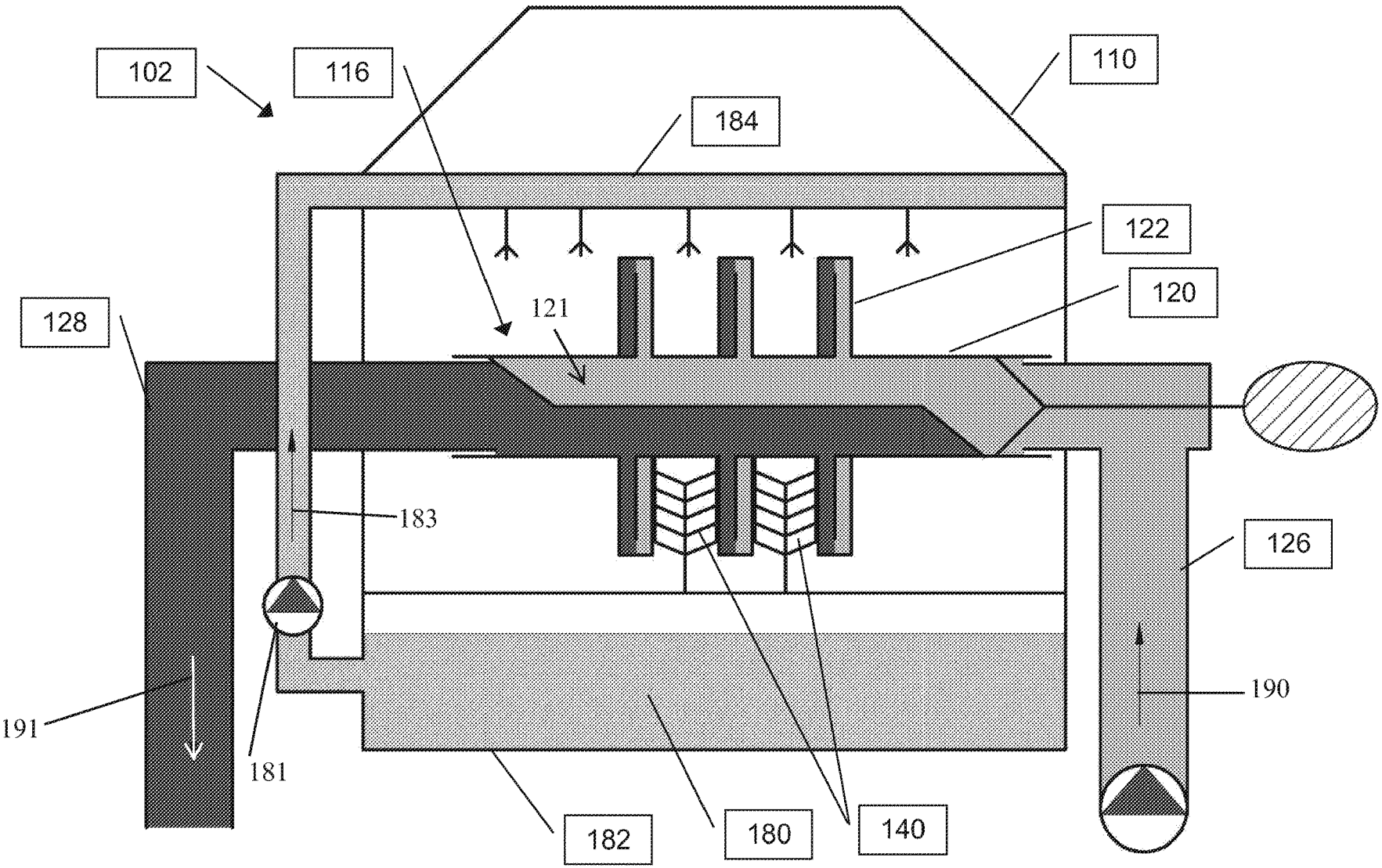

FIG. 5 illustrates another embodiment of a heat exchanging system 102 of the present invention. This system 102 includes components similar to those shown and described above for the heat exchanging system 2 of FIGS. 1-4, with similar components having numbers increased by "100".

The heat exchanging system 102 is shown as installed in a cooling tower, which serves as the tank/shell 110 of the system.

In this configuration, the cooling liquid 180 is pumped by a pump 181 from reservoir 182 (in the direction of the arrow 183) to the spray nozzles 184. The fluid passes over the manifold tube 120 and the heat exchanging plates 122 as the fluid, while being cooled, passes from the fluid intake 126 (in the direction of the arrow 190) through the manifold tube 120 and the heat exchanging plates 122, where it exits through the fluid outlet 128 (in the direction of the arrow 191). Cleaning elements 140 are positioned between the plates 122, but may be varied as needed, to accommodate the design of each individual cooling tower installation.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

It will be appreciated by persons skilled in the art that the present invention is not limited to what has been particularly shown and described hereinabove. Rather the scope of the present invention is defined by the appended claims and includes both combinations and sub-combinations of the various features described hereinabove as well as variations and modifications thereof, which would occur to persons skilled in the art upon reading the foregoing description.

The invention claimed is:

1. A heat exchanging system comprising:

a heat exchanger including:

(a) a manifold tube including an interior for receiving fluid, a longitudinal axis extending through a center of the interior, the manifold tube including a fluid intake opening and a fluid outlet opening, and a manifold barrier extending through the interior for dividing said manifold tube into an intake region and an outlet region each of the intake region and the outlet region including at least one aperture for fluid flow therethrough, the fluid intake opening to the interior and the fluid outlet opening out of the interior are on opposite ends of the longitudinal axis; and, (b) a plurality of heat exchanging plates extending from said manifold tube and in communication with the intake region of the manifold tube and the outlet region of the manifold tube, each of said plurality of heat exchanging plates including at least one plate barrier substantially parallel to a respective one of the heat exchanging plates so as to define a fluid flow path within said respective one of the heat exchanging plates, from said intake region of said manifold tube to said outlet region of said manifold tube, each of the at least one plate barrier of each of the heat exchanging plates of the plurality of plates terminates in a respective inlet of each heat exchanging plate and in a respective outlet of each heat exchanging plate.

2. The heat exchanging system of claim 1, wherein said manifold barrier divides said interior of said manifold tube substantially longitudinally along the longitudinal axis extending through the center of the manifold tube.

3. The heat exchanging system of claim 2, wherein said at least one heat exchanging plate includes a plurality of heat exchanging plates extending substantially perpendicularly from said manifold tube, each of said heat exchanging plates including at least one plate barrier defining a fluid flow path within said heat exchanging plate, from said intake region of said manifold tube to said outlet region of said manifold tube.

4. The heat exchanging system of claim 1, additionally comprising: cleaning elements deployed adjacent to said heat exchanging plates, wherein the cleaning elements comprise blades positioned between the heat exchanging plates so as to frictionally engage said heat exchanging plates as said heat exchanging plates rotate.

5. The heat exchanging system of claim 1, wherein said manifold tube is configured to rotate about the longitudinal axis of said manifold tube.

6. The heat exchanging system of claim 1, additionally comprising a tank including at least one fluid inlet and at least one fluid outlet, said tank enveloping at least a portion of said heat exchanger.

7. The heat exchanging system of claim 6, wherein the tank is configured for facilitating the flow of a first fluid therethrough, and the heat exchanger is configured for facilitating the flow of a second fluid therethrough.

8. The heat exchanging system of claim 1, wherein said manifold tube is mounted inside a cooling tower.

9. The heat exchanging system of claim 1, wherein the at least one plate barrier comprises multiple plate barriers each terminating in a respective inlet and outlet.

10. A heat exchanger comprising:

a manifold tube including an interior for receiving fluid, a longitudinal axis extending through a center of the interior, the manifold tube including an opening for fluid intake and an opening for fluid outlet, and a manifold barrier substantially parallel to the longitudinal axis and extending through the interior for dividing said manifold tube into an intake region and an outlet region, the intake region including at least one aperture for fluid flow therethrough, and the outlet region including at least one aperture for fluid flow therethrough; and, a plurality of heat exchanging plates extending from said manifold tube and in communication with the at least one aperture of the intake region of the manifold tube and the at least one aperture of the outlet region of the manifold tube, each of said plurality of heat exchanging plates including at least one plate barrier defining a first channel having a respective inlet of each heat exchanging plate and a second channel having a respective outlet of each heat exchanging plate, the at least one plate barrier substantially parallel to a respective one of the heat exchanging plates and configured for forming a fluid flow path within each of said heat exchanging plates, into the respective inlet, through the first channel and second channel and out of the respective outlet of each respective heat exchanging plate, the fluid flow path defined from said intake region of said manifold tube to said outlet region of said manifold tube.

11. The heat exchanger of claim 10, wherein said manifold barrier divides said interior of said manifold tube substantially longitudinally along the longitudinal axis extending through the center of the manifold tube.

12. The heat exchanger of claim 11, wherein the interior is hollow.

13. The heat exchanger of claim 10, wherein said manifold tube is configured to rotate about the longitudinal axis.

14. The heat exchanger of claim 10, additionally comprising: cleaning elements deployed adjacent to said heat exchanging plates, wherein the cleaning elements comprise blades positioned between the heat exchanging plates so as to frictionally engage said heat exchanging plates as said heat exchanging plates rotate.

* * * * *